US005678892A

United States Patent [19]

Heitlinger

[11] Patent Number: 5,678,892

[45] Date of Patent: Oct. 21, 1997

[54] ADJUSTABLE FURNITURE APPARATUS

[76] Inventor: Karl-Leo Heitlinger, Tannenweg 9, 73525 Schwäbisch-Gmünd, Germany

[21] Appl. No.: 404,509

[22] Filed: Mar. 15, 1995

[51] Int. Cl.[6] ..... A47C 3/04; A47C 3/20

[52] U.S. Cl. ..... 297/344.18; 297/353; 297/239; 297/383; 297/440.16; 297/440.24; 248/188.5; 248/414

[58] Field of Search ..... 294/353, 344.18, 294/239, 410, 383, 440.16, 440.24; 248/188.5, 414, 161; 403/108, 372, 109

[56] References Cited

U.S. PATENT DOCUMENTS

| | | | |
|---|---|---|---|
| 1,664,766 | 4/1928 | Boulogne | 297/353 |
| 1,922,418 | 8/1933 | Conant | 297/344.18 |
| 2,140,635 | 12/1938 | Konarski | 297/344.18 |
| 2,989,343 | 6/1961 | Loesch | 297/239 |
| 3,153,123 | 10/1964 | Harman | 248/414 |
| 3,765,718 | 10/1973 | Chen | 297/353 |

FOREIGN PATENT DOCUMENTS

| | | | |
|---|---|---|---|
| 0242371 | 1/1987 | Denmark | 297/410 |

*Primary Examiner*—Milton Nelson, Jr.
*Assistant Examiner*—Anthony D. Barfield
*Attorney, Agent, or Firm*—Jansson & Shupe, Ltd.

[57] ABSTRACT

An adjustable furniture device having at least one adjustable longitudinal support element including a female section and a male section in telescoping engagement, with positionally-adjustable devices interposed between the male and female members to permit longitudinal adjustment of the support element, and thereby adjustment, for example, of height.

12 Claims, 3 Drawing Sheets

ADJUSTABLE FURNITURE APPARATUS

FIELD OF THE INVENTION

This invention is related generally to furniture (sometimes referred to herein as "furniture pieces") and, more specifically, to furniture which may be adjusted in height and certain other respects.

BACKGROUND OF THE INVENTION

The furniture pieces of the invention have at least one adjustable longitudinal support element (i.e., elongate element which is adjustable in length), with one female section and one or several adjustable male sections. This novel invention permits the length of engagement of the male and female members, and thereby the furniture height, to be adjusted in a simple and inexpensive manner.

Such pieces of furniture are known, for example, as vertically adjustable tables or chairs, whereby the legs consist of two sections which can be adjusted and fastened to each other. (German Patent DE 32 45 280 illustrates such a device.) However, the adjusting mechanisms of such devices of the prior art are often prohibitively expensive.

A piece of furniture having an easily assembled and easily adjustable longitudinal adjusting mechanism which provides strong support would represent a significant advance.

OBJECTS OF THE INVENTION

It is an object of this invention to provide an improved furniture apparatus overcoming some of the problems and shortcomings of the prior art.

A further object of the invention is to provide an improved furniture apparatus in which the height may be adjusted.

A further object of this invention is to provide a piece of furniture with an improved adjustable longitudinal support element.

It is also an objective of the invention to provide an improved furniture apparatus in which the height may be rapidly and easily adjusted to a variety of positions.

Yet another object is to provide an improved furniture apparatus which is stackable.

A further object is to provide an improved furniture apparatus which is easily transportable.

It is also an object to provide an improved chair in which the seat height may be adjusted.

An additional objective is to provide an improved furniture apparatus which is inexpensive to manufacture and sell.

A still further object of this invention is to provide adjustable furniture apparatus with improved sturdiness.

The purpose of the present invention is to provide, at a reasonable cost, a piece of furniture in which longitudinal adjustment of adjustable elongate members can be carried out easily.

These and other important objects will be apparent from the following descriptions and from the drawings.

SUMMARY OF THE INVENTION

The invention accomplishes these and other objectives.

The adjustable longitudinal support elements of this invention have male and female leg sections which can be inserted into each other. The male member has several substantially annular grooves that are at least partly circumferential and are equally spaced along the axis of the male member in predetermined dimensional increments. A positionally-adjustable abutment device is interposed between the male member and female member. In preferred embodiments, the abutment device is a rubber ring or flexible (elastic) plastic ring which is fit into at least one of the grooves. The inner diameter of the female section is expanded at its terminal area that faces the inserted section in order to receive the rubber ring or plastic ring in a clamping recess which is adjusted to the outer diameter of the rubber ring or plastic ring. The inner diameter of the female section of the area which is juxtaposed to the area stated above is adjusted to the outer diameter of the male section in order to produce a sliding seat.

The support elements can thereby be taken apart in two male and female sections and can easily be assembled and adjusted to the desired length in a telescoping manner. This is done in such a manner that the rubber rings slide or roll into the respective grooves. The supporting force of the adjustable longitudinal support element is thereby surprisingly high. It is sufficient for the recess to act in a clamping manner at its supporting area. This type of adjustment also takes into consideration the fact that a certain adjustment, once selected, generally need not often be changed.

In one preferred embodiment, the male section of the support element is the upper leg section and the female section preferably is the lower leg section of a chair or table. The chair or table can easily be taken apart and transported. Such a chair fits, for example, into a suitcase which is the size of a briefcase.

The design of the preferred holding mechanism is advantageous because each of the grooves has a round cross-section and the rubber or plastic rings are O-rings. This allows in a simple and inexpensive manufacturing process and easy adjustment of the rubber rings.

DETAILED DESCRIPTIONS OF THE PREFERRED EMBODIMENTS

Figure 1:
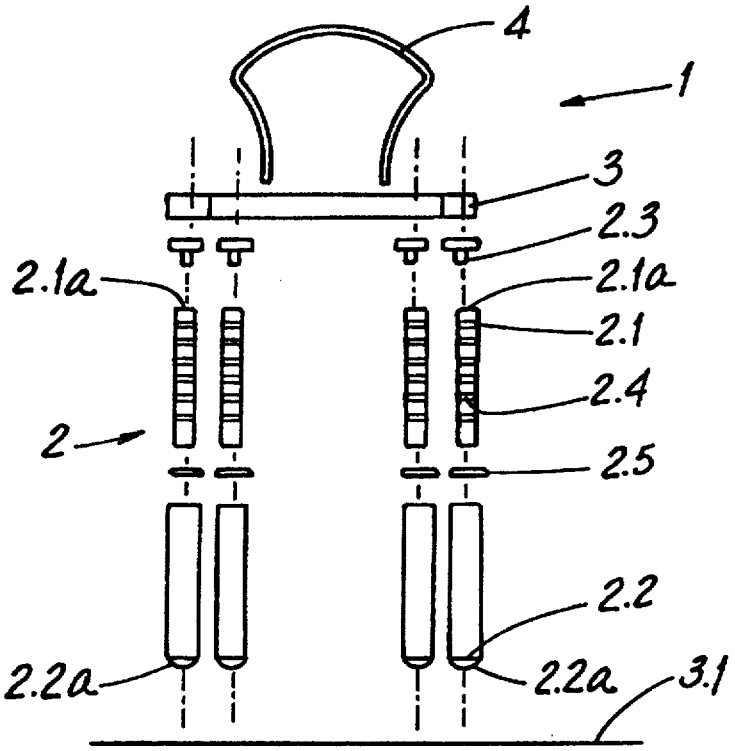
FIG. 1 is a schematic front view of the piece of furniture—a chair—which is taken apart.

FIG. 1 shows a chair 1 which is one embodiment of the invention. FIG. 1 is a front view of chair 1 which is taken apart into its main components. A back rest 4 is attached to the top of the seat 3. One or several, preferably four, support elements 2, in the form of legs, are attached to the bottom of seat 3 by means of fastening elements 2.3. The legs 2 consist of a male member 2.1 in telescoped engagement with a female member 2.2. Male and female members 2.1 and 2.2 each have distal ends 2.1*a* and 2.2*a*, respectively. One or the other distal end may be attached to the bottom side of the substantially flat support member such as seat 3 with a suitable fastener. This arrangement holds seat 3, or other support member, substantially parallel to a reference plane 3.1.

A positionally-adjustable abutment device 2.5 is interposed between male and female members 2.1 and 2.2 to vary the length of support element 2 and to fix male member 2.1 and female member 2.2. Abutment device 2.5 may be rubber rings or elastic plastic rings. Rubber rings 2.5 are preferably designed as O-rings; and the cross-section of grooves 2.4 are correspondingly round.

Rings 2.5 are pulled over male member 2.1 and are held there in substantially annular grooves 2.4. Grooves 2.4 are spaced along male member 2.1 in predetermined dimensional increments for receiving rings 2.5. This novel arrangement permits rings 2.5 to be positionally-adjustable along male member 2.1 in predetermined dimensional increments.

Figure 2A:
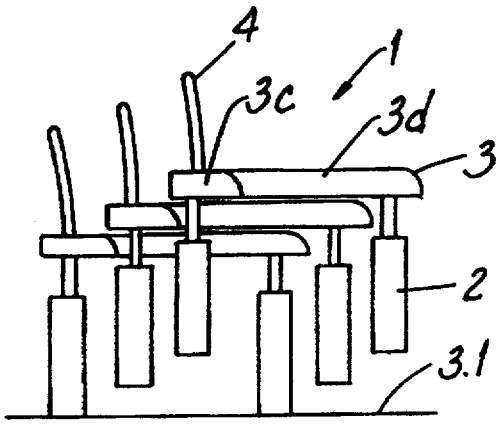
FIGS. 2A and 2B show several chairs in a stacked arrangement.
Figure 2B:
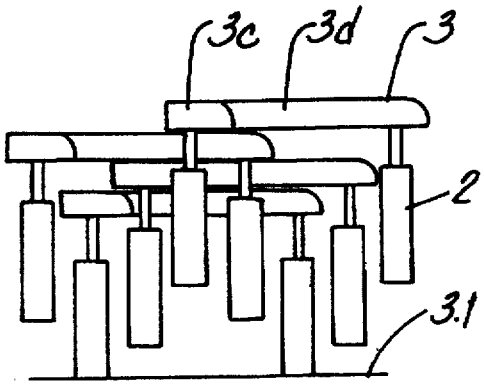

In FIG. 2A a number of chairs 1 are shown stacked together. Chairs 1 are substantially upright. Chairs 1 can easily be stacked due to the shape of their seats 3 and the arrangement of legs 2. FIG. 2B shows another way of stacking chairs 3 whereby the back rests 4 are removed and before stacking. Chairs 1 alternately project towards the back and the front.

Figure 3A:
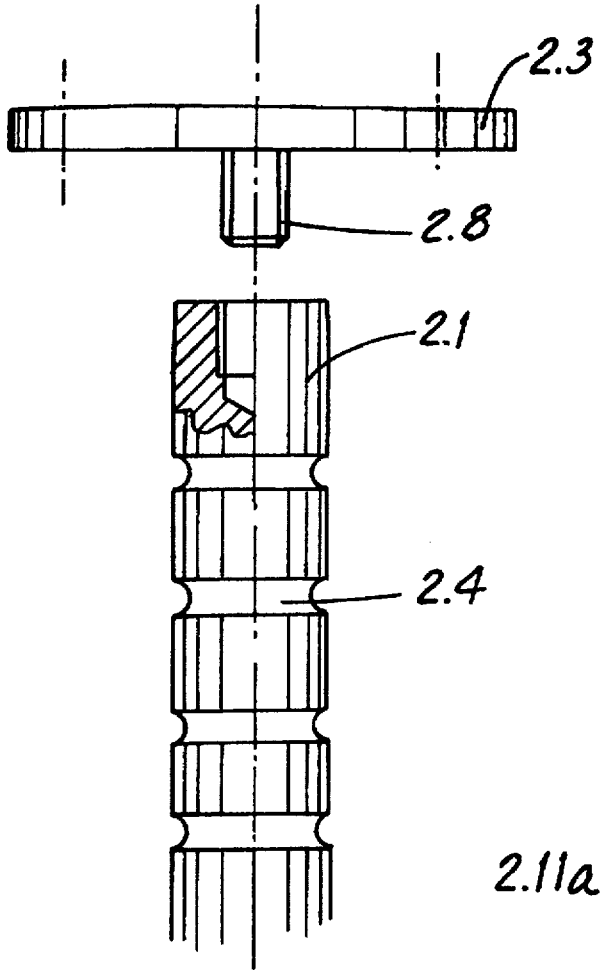
FIG. 3A shows the attachment of an adjustable chair leg to a fastening element.

FIG. 3A shows a fastening element 2.3 which is attached at the bottom of seat 3 and is equipped with a threaded pin 2.8. Male member 2.1 (or female member 2.2) can be removably attached to seat 3 by being screwed onto threaded pin 2.8. As an alternative, a different fastening or clamping mechanism, such as a bayonet fitting (not shown), can be selected. This bayonet fitting can be operated very rapidly.

Figure 3B:
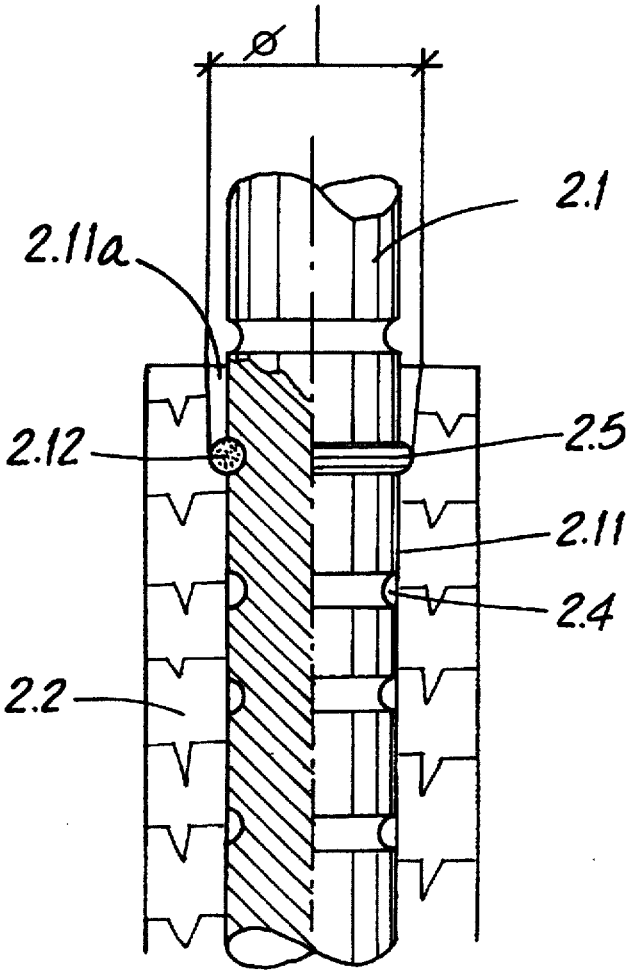
FIG. 3B shows male and female leg sections which are attached to each other with a holding mechanism.

Grooves 2.4 are clearly visible in FIG. 3A and in FIG. 3B. FIG. 3B shows male and female members 2.1 and 2.2 (attached to each other) whereby female member 2.2 is the outer leg portion and male member 2.1 is inserted in female member 2.2. Female member 2.2 has an interior passage 2.11 with an expanded recess 2.11*a* and an abutment shoulder 2.12. Rubber ring 2.5 contacts and fits into shoulder 2.12. Rubber ring 2.5, which is placed around male member 2.1, is fixed, for example, by a clamping effect in such a manner that male member 2.1 can only be inserted into female member 2.2 up to the point where rubber ring 2.5 sits on shoulder 2.12 of recess 2.11*a*, and is securely fixed in this position. To achieve a secure support, it is sufficient for there to be only one expanded recess 2.11*a* at the upper rim area of female member 2.2. The diameter of interior passage 2.11 is adjusted to the outer cross-section contour of male member 2.1, so that male member 2.1 can be inserted easily into passage 2.11 without play.

Figure 4A:
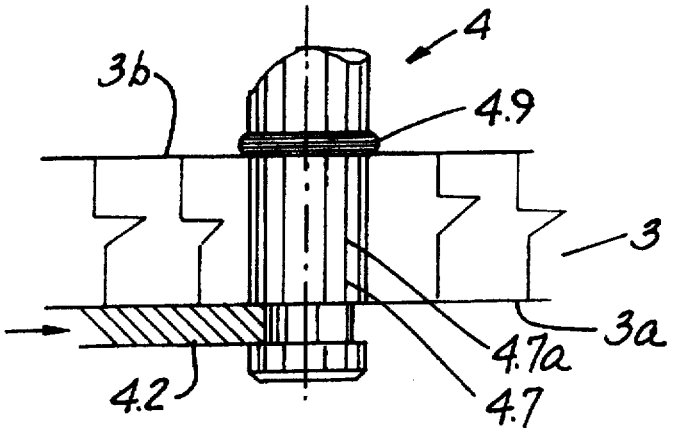
FIGS. 4A and 4B are sectional views of a back rest support which is attached to a seat and uses the holding mechanism according to FIG. 3B.
Figure 4B:
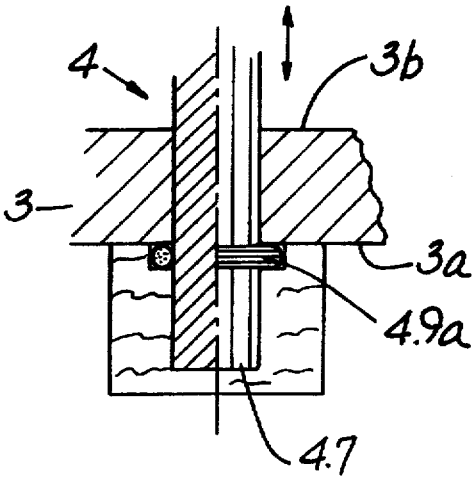
Figure 5:
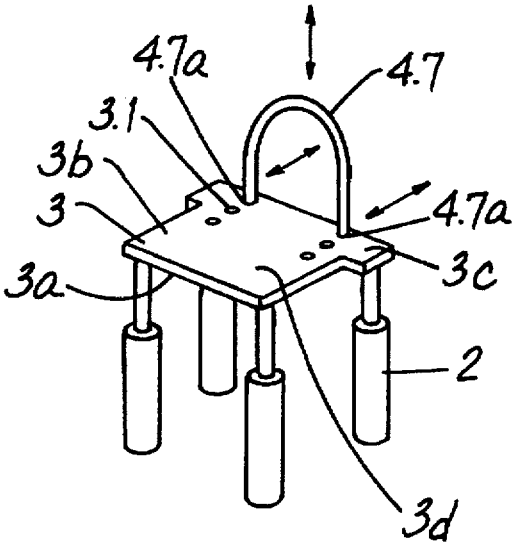
FIG. 5 is a perspective view of the back rest depth adjustment according to FIGS. 4A and 4B.

FIGS. 4A, 4B and 5 show examples of different embodiments for attachment of back rest 4 to seat 3. The same holding mechanism is used as described above. A back rest support 4.7 has at least two ends 4.7*a* each of which is inserted into one of the paired openings 3.7 at the back section of seat 3. As shown in FIG. 1, back rest support 4.7 can, for example, be designed as a loop with two ends 4.7*a* which can be inserted into openings 3.7 of seat 3 in a detachable manner. A tight fit of back rest 4.7 support in holes 3.7 is preferred.

According to FIGS. 4A and 4B, ends 4.7*a* are positioned through openings 3.7 and protrude from the bottom surface 3*a* of seat 3. A positionally-adjustable abutment device 4.9 is secured with respect to back rest 4.7 abutting seat top portion 3*b*. The stop for back rest 4.7 is formed by a holding ring 4.9 which rests on the seat top surface 3*b* when back rest support 4.7 is inserted. Several grooves (not shown) can be available in back rest 4.7 for the rings 4.9 in order to achieve adjustment of height.

As shown in FIG. 4B, a respective rubber ring 4.9*a* can also be adjusted under seat 3 to hold back rest 4.7. In FIG. 4B, a rubber or plastic ring 4.9*a* is arranged under seat 3 in order to prevent movement of back rest 4.7. The ring 4.9*a* has a slightly smaller inner diameter than the back rest ends 4.7*a*, so that it is held securely.

FIG. 5 shows a design with depth adjustment for back rest 4. For this purpose, several openings 3.7 in the form of borings are provided and are distributed in a vertical direction. Two rows of openings 3.7 are present for both ends 4.7*a* of back rest support 4 which can be inserted therein. The insertion of back rest support 4.7 and the adjustment options can also be seen in FIG. 5.

For easy stacking, the back section 3*c* of seat 3 may be widened as compared to the front section 3*d*, as shown in FIGS. 2A, 2B and 5. In this embodiment, the support member is a seat 3 having a top and bottom surface 3*b* and 3*a* and two pairs of opposed elongate support elements 2 attached to and projecting from bottom surface 3*a*. The distance between the first pair of support elements 2 is greater than the distance between the second pair of support elements 2 so that a plurality of chairs 1 may be stacked one on top of the other.

A device for storing the disassembled parts (not shown), such as leg sections 2.1 and 2.2, back rest 4 and perhaps rubber rings 2.5 and fastening elements, may be provided at the bottom of seat 3.

Rubber rings 2.5, 4.9 and 4.9*a*, referred to above, can also be plastic rings, as stated previously, in which the plastic has characteristics similar to the rubber material.

The principle of the described adjustable longitudinal mechanism, with rubber or plastic rings which fit into grooves, can be used for many applications, including height adjustment of chairs, and adjustment of backrests, or for the height adjustment of tables, closets and stands such as music stands, light stands, wardrobes, desks or similar objects. The use of this principle is also possible for horizontal adjustable elongate supports. Finally, the described adjusting mechanism can be used with two or more leg sections 2.1 and 2.2.

While the principles of this invention have been described in connection with specific embodiments, it should be understood clearly that these descriptions are made only by way of example and are not intended to limit the scope of the invention.

What is claimed:

1. In a chair having legs adjustable in length, the improvement wherein each leg comprises:

a male member having a plurality of grooves spaced therealong;

a female member in telescoped engagement with the male member, such female member having an inner wall and an enlarged recess in the wall, a surface of which forms an abutment shoulder; and a leg abutment device received in only one of the grooves and engaged against the shoulder for coacting therewith and holding the male member and female member in fixed relationship to each other;

and wherein the chair further includes:

a seat with a top surface and a pair of openings formed in the seat;

a back rest with at least two back rest ends each engaging a seat opening and having a groove; and an upper back rest abutment device secured with respect to each back rest groove and abutting the seat top surface.

2. The chair of claim 1 wherein the abutment device is positionally-adjustable into each of the plurality of grooves along the male member.

3. The chair of claim 2 wherein the grooves are annular and are spaced along the male member in substantially uniform dimensional increments for receiving the abutment device.

4. The invention of claim 3 wherein the abutment device is a flexible ring sized to be received in the grooves.

5. The chair of claim 1 wherein:

the chair stands substantially upright; and the abutment device is engaged against the shoulder when the chair is upright.

6. The chair of claim 5 wherein:

the male member has a distal end;

the female member has a distal end;

the distal end of either the male member or female member is attached to a substantially flat support member; whereby the support member is held substantially parallel to a reference plane.

7. The chair of claim 6 wherein the seat has a widened back section, top and bottom surfaces and first and second pairs of opposed elongate support elements attached to and projecting from the bottom surface, the first pair of support elements being attached to the widened back section so that the distance between the first pair of support elements is greater than the distance between the second pair of support elements, whereby a plurality of chairs may be stacked one on top of the other.

8. The chair of claim 7 wherein the seat has a front section which has substantially parallel side edges and is narrower than the back section and the second pair of support elements is attached to and projects from the bottom surface.

9. The chair of claim 1 wherein the chair seat has paired openings spaced from front to back for receiving the back rest ends whereby the depth of the seat may be adjusted.

10. In a chair having legs adjustable in length, the improvement wherein each leg comprises:

a male member having a plurality of grooves spaced therealong;

a female member in telescoped engagement with the male member, such female member having an inner wall and an enlarged recess in the wall, a surface of which forms an abutment shoulder; and a leg abutment device received in only one of the grooves and engaged against the shoulder for coacting therewith and holding the male member and female member in fixed relationship to each other;

and wherein the chair further includes:

a seat with a bottom surface and a pair of openings formed in the seat;

a back rest with at least two back rest ends;

each back rest end extends through a respective one of the pair of seat openings and protrudes from the bottom surface;

a lower back rest abutment device is secured with respect to each protruding back rest end and abuts the bottom surface; and a female member engages each protruding back rest end, whereby the back rest is held in place.

11. A chair having:

a plurality of adjustable elongate support elements, each having a male member, a female member in telescoped engagement with the male member, and a positionally-adjustable leg abutment device interposed between the male member and the female member;

a seat having a top and bottom surface and a pair of openings formed therein;

a back rest with at least two ends, each engaging a respective seat opening and protruding from the bottom surface; and a positionally-adjustable upper back rest abutment device secured with respect to each back rest end and abutting the seat top surface;

whereby the length of engagement of the female member with the male member may be adjusted, the height of the back rest may be adjusted and the back rest is held in place.

12. The invention of claim 11, wherein the seat has paired openings spaced from front to back for receiving the back rest ends, whereby the depth of the seat may be adjusted.

* * * * *